US006788206B1

(12) United States Patent
Edwards

(10) Patent No.: US 6,788,206 B1
(45) Date of Patent: Sep. 7, 2004

(54) PATIENT MONITORING SYSTEM

(76) Inventor: Donald A. Edwards, 10020 N. Sheridan Dr., Mequon, WI (US) 53092

( * ) Notice: Subject to any disclaimer, the term of this patent is extended or adjusted under 35 U.S.C. 154(b) by 29 days.

(21) Appl. No.: 10/235,596

(22) Filed: Sep. 5, 2002

(51) Int. Cl.[7] ..... G08B 23/00

(52) U.S. Cl. ..... 340/573.1; 340/573.7; 367/99

(58) Field of Search ..... 340/573.1, 573.4, 340/573.7, 575, 555; 367/96, 99

(56) References Cited

U.S. PATENT DOCUMENTS

| | | | | |
|---|---|---|---|---|
| 3,961,201 | A | | 6/1976 | Rosenthal |
| 3,991,746 | A | | 11/1976 | Hanna |
| 4,179,692 | A | | 12/1979 | Vance |
| 4,196,425 | A | | 4/1980 | Williams, Jr. et al. |
| 4,197,528 | A | | 4/1980 | Gibson |
| 4,203,098 | A | | 5/1980 | Muncheryan |
| 4,242,672 | A | | 12/1980 | Gault |
| 4,295,133 | A | | 10/1981 | Vance |
| 4,484,043 | A | | 11/1984 | Musick et al. |
| 4,565,910 | A | | 1/1986 | Musick et al. |
| 4,583,084 | A | | 4/1986 | Henderson et al. |
| 4,633,237 | A | | 12/1986 | Tucknott et al. |
| 4,638,307 | A | | 1/1987 | Swartout |
| 4,750,584 | A | | 6/1988 | Tanaka et al. |
| 4,858,622 | A | | 8/1989 | Osterweil |
| 4,890,266 | A | | 12/1989 | Woodward |
| 4,907,845 | A | | 3/1990 | Wood |
| 5,353,012 | A | | 10/1994 | Barham et al. |
| 5,471,198 | A | | 11/1995 | Newham |
| 5,519,380 | A | | 5/1996 | Edwards |
| 5,635,905 | A | * | 6/1997 | Blackburn et al. ..... 340/555 |
| 5,654,694 | A | | 8/1997 | Newham |
| 5,780,788 | A | | 7/1998 | Eschenbrenner et al. |
| 5,844,488 | A | | 12/1998 | Musick |
| 5,914,660 | A | * | 6/1999 | Mesibov et al. ..... 340/573.7 |
| 5,943,295 | A | * | 8/1999 | Varga et al. ..... 367/99 |
| 6,025,782 | A | | 2/2000 | Newham |
| 6,163,903 | A | | 12/2000 | Weismiller et al. |
| 6,166,644 | A | | 12/2000 | Stroda |
| 6,204,767 | B1 | | 3/2001 | Sparks |
| 6,208,250 | B1 | | 3/2001 | Dixon et al. |
| 6,239,706 | B1 | | 5/2001 | Yoshiike et al. |
| 6,252,512 | B1 | | 6/2001 | Riley |
| 6,297,738 | B1 | | 10/2001 | Newham |
| 6,583,727 | B2 | * | 6/2003 | Nunome ..... 340/665 |
| 2002/0070866 | A1 | | 6/2002 | Newham |

OTHER PUBLICATIONS

Posey Healthcare Products Guide, Prevent Falls Without Resorting to Restraint, 2 pages (1994).
Advertisement for Bed–Check Corporation, p. 6, *Contemporary Long Term Care Magazine*.
Bed–Check Control Unit information sheet.
Tabs Mobility Monitor Product Guide, Reduce the Risk of Falls at Home, 2 pages.
Advertisement for Tabs Mobility Monitor, p. 96 (Sep. 1998).
Advertisement for Posey Personal Alarm, p. 14 (undated).

* cited by examiner

*Primary Examiner*—John Tweel
(74) *Attorney, Agent, or Firm*—Boyle Fredrickson Newholm Stein & Gratz S.C.

(57) ABSTRACT

A patient monitoring system can be used in multiple locations to monitor a patient using distinct monitoring strategies. For instance, the same system can be used both on a chair and on a bed. When a base unit of the system is attached to a chair to monitor an area or volume in the vicinity of the chair, it is typically set to sound an alarm when a transmitted signal takes too long to be reflected back to the base unit, indicating that the patient has moved beyond the proper range for sitting. The system also features remote unit(s) and module(s) that can be attached to the base unit, directly or indirectly, to facilitate perimeter monitoring when a patient is lying in a bed. In this case, the system is typically set to sound an alarm when a transmitted signal is interrupted by the patient and reflected back, indicating that the patient may have attempted to get out of bed.

24 Claims, 9 Drawing Sheets

PATIENT MONITORING SYSTEM

BACKGROUND OF THE INVENTION

1. Field of the Invention

The present invention relates to a contactless monitoring system and, more particularly, to a monitoring system that can be used both for monitoring an individual seated in a chair and for monitoring an individual lying in a bed. The invention additionally relates to an improved structure for removably mounting a monitoring system on the seatback of a chair. Because of its versatility, this invention could also be used to monitor a door, room, entry way, walker, hallway, bathroom or toilet.

2. Discussion of the Related Art

As the population ages, an increasing number of people are developing dementia and require continuous supervision. Even while seated or lying in bed, patients with dementia must be monitored to ensure that they do not fall from the chair or bed, either inadvertently or by attempting to get out of the chair or bed unassisted.

In a homecare situation, this requires that the caregiver be at the patient's side constantly, subjecting the caregiver to severe psychological stress, physical deterioration, burnout, and even premature death. The need has therefore arisen to help caregivers monitor patients and still be able to rest, perform household chores, etc. without worrying about the patient's location and safety.

In a hospital, nursing home, hospice, or other health care institution, it is impracticable to have a staff member assigned to only one patient. However, patients in health care institutions are often predisposed to falling. For many of these patients, who may be frail or ill to begin with, a minor fall constitutes a significant health risk. Accordingly, a simple, inexpensive, contactless method of monitoring the movements of a patient without requiring constant observation or restraints is needed.

Numerous methods for preventing falls from chairs currently exist. For instance, physical restraints are commonly used to prevent a patient from exiting a wheelchair or hospital bed or other apparatus. Although the use of physical restraints is effective in confining the individual to a specific area, there are psychological side effects that result from the individual's perceived loss of his or her freedom and dignity, as well as the potential for physical injury resulting from struggling to be free of the restraints. As a result nursing homes and hospitals are required to become restraint free while maintaining a safe environment for patients and residents.

Electronic monitoring devices help alleviate many of the negative effects of physical restraints and have a wider range of uses. These monitoring systems typically fall into three major categories: pressure detection pads, physical attachment to a monitor via string or cord, and intensity-based measurements of transmitted energy beams. These solutions are problematic in terms of cost; patient comfort; high numbers of errant, or nuisance, alarms; simplicity; and mobility.

For example, pressure detection pads must be replaced frequently because they are easily damaged and rendered inoperable. They also require a person to have already left his or her place before sounding an alarm, rather than warning of imminent danger. Conversely, lightweight people, such as many frail elderly people, can trigger the alarm by making small movements that redistribute their weight. To compensate, these systems must have time delays before alarming when a person leaves the bed or chair.

Physical attachments to monitors by way of cords and clothing clips are irritating to patients because they are visible to them and can wrap around limbs and cut off circulation. These products are not suitable for bed monitoring of an active person. They are also easily removed by the monitored person or other residents or patients, rendering them completely ineffective. Distance adjustment is cumbersome. Staff must therefore constantly check to ensure patient compliance. Furthermore, even where there is compliance, an inadvertent movement pulling out the attachment requires staff attention and resetting the monitor even when the patient returns to his or her location immediately.

Systems relying on intensity-based measurements of transmitted energy are relatively complex. Under one type of system, a transmitter is positioned in one location near the patient and a receiver is positioned in a second location so that it continually receives the transmitted beam when the patient is in a desired position. If the individual moves outside the desired position, the beam is broken and an alarm is triggered. Although this approach does not require any of the restrictive methods as required in the two previous categories and has a wider range of applications, it only indicates the presence or absence of the monitored individual in the transmitted area. These systems are not portable and are not effective for both bed and chair monitoring because of the difficulties in measuring energy intensity. They can be confused by various environmental energy beam transmissions, a person's clothing, size and shape. Furthermore, it cannot detect small changes in the patient's position, such as slumping.

The complexity and sensitivity of a monitoring system relying on energy intensity-based measurements also requires that transmitters and receivers be permanently or semi-permanently mounted in a specified location in order to adequately monitor the area. This latter requirement renders the system poorly suited to monitor either a patient seated in a chair or a patient lying in a bed. In fact, no known electronic monitoring system is configured to be readily adaptable for both types of measurement using at least some of the same equipment. In addition, known chair monitoring systems are not easily mountable on the back of a chair in a manner that provides them with a wide range of monitoring ability yet still permits them to be easily mounted on a wide variety of chairs.

The need therefore has arisen to provide a monitoring system which is effective, provides instant alarms while still in the bed or chair, eliminates strings, cords, pads and patient attachments, does not interfere with normal patient movement or generate an alarm due to such movement, is simple to set up, install, and use, does not require permanent installation on furniture, and/or can be easily reconfigured from one monitoring mode, such as monitoring a patient seated in a chair, to another monitoring mode, such as monitoring a patient lying in a bed. The ideal monitor meeting this need would be adaptable to virtually any conceivable patient orientation, such as the monitoring of a patient lying in a bed positioned in an open space, along a wall, or in a corner.

The need has additionally arisen to provide a monitor that can be easily mounted on the back of a chair in a manner that provides a wide range of monitoring ability yet permits easy mounting on a wide variety of chairs.

SUMMARY OF THE INVENTION

A patient monitoring system having several advantageous features is disclosed. The same can be used in different locations and/or in different monitoring modes. For instance, it is usable on both a chair and a bed. When used on a chair, a base unit of the system can be used in conjunction with a chair cover to attach it to the chair with ease. The base unit preferably relies on energy intensity-independent measurements to determine whether a patient is within a defined area of the chair, and an alarm is generated when the patient is not in the defined area.

When used on a bed, the base unit operates in the opposite manner of the chair monitor and can be connected to a remote unit and one or more plug-in modules. The base unit, remote unit, and plug-in module(s) can send and receive signals, and, in conjunction, are able to determine whether a received signal is within a desired perimeter, and thus whether a patient is within a monitored area. The base unit can generate an alarm if a received signal is outside the desired parameter.

A method of using such a system, in which a base unit is alternatively attached to two different structures such as a chair or a bed, is also described. In addition, alternate strategies for monitoring a patient, depending on whether the patient is in a chair or in a bed, are discussed, and a switch for changing from one strategy to the other is disclosed. Preferably, the system is switchable between monitoring modes such that it relies on a volumetric-based measuring approach when the patient is seated in a chair and a perimeter-based measuring approach when the patient is lying in a bed.

BRIEF DESCRIPTION OF THE DRAWINGS

Preferred exemplary embodiments of the invention are illustrated in the accompanying drawings, in which like reference numerals represent like parts throughout, and in which.

DETAILED DESCRIPTION OF THE PREFERRED EMBODIMENTS

1. Resume

A preferred embodiment of the present invention is a patient monitoring system that can be used in multiple locations for detecting undesired movement of the patient in or from the monitored location. Two preferred applications are for monitoring a patient seated in a chair and for monitoring a patient lying in bed. When a base unit of the system is attached to a chair, it is set to sound an alarm when a transmitted signal takes too long to be reflected back to the base unit, indicating that the patient has moved beyond the proper range for sitting. The system also features remote unit(s) and module(s) that can be attached to the base unit, directly or indirectly, to facilitate perimeter monitoring when a patient is lying in a bed. In this case, the system is set to sound an alarm when a transmitted signal is interrupted by the patient and reflected back, indicating that the patient may have attempted to get out of bed.

2. Construction of Exemplary Monitoring System

Figure 1:
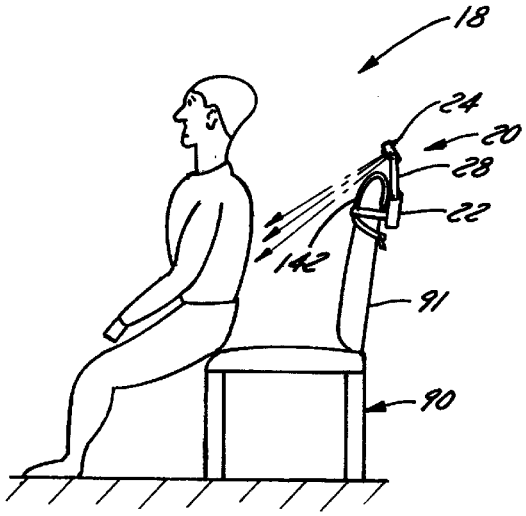
FIG. 1 schematically illustrates a monitoring system constructed in accordance with a preferred embodiment of the present invention and mounted on the back of a chair.
Figure 11:
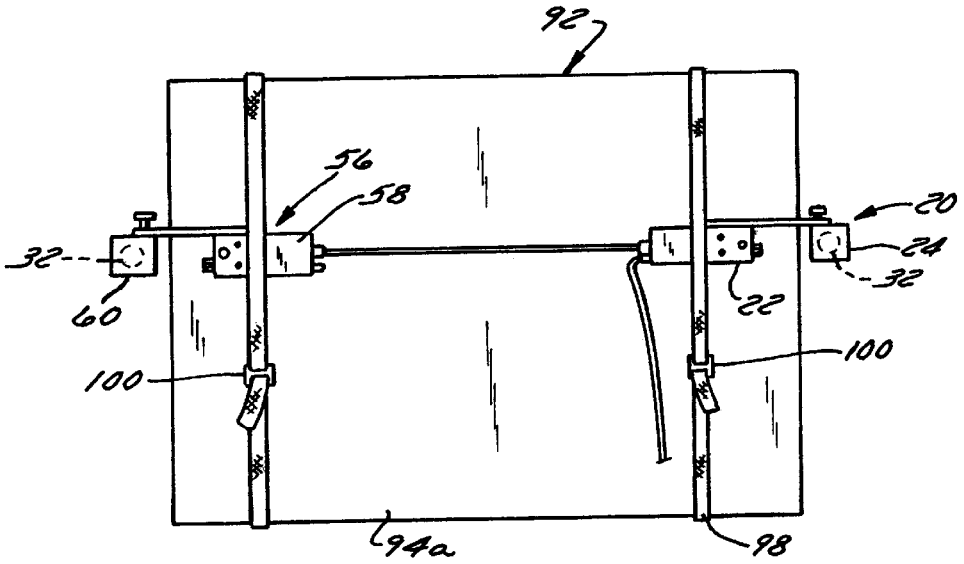
FIG. 11 is a schematic rear view of the monitoring system as mounted on a bed in one possible configuration.
Figure 12:
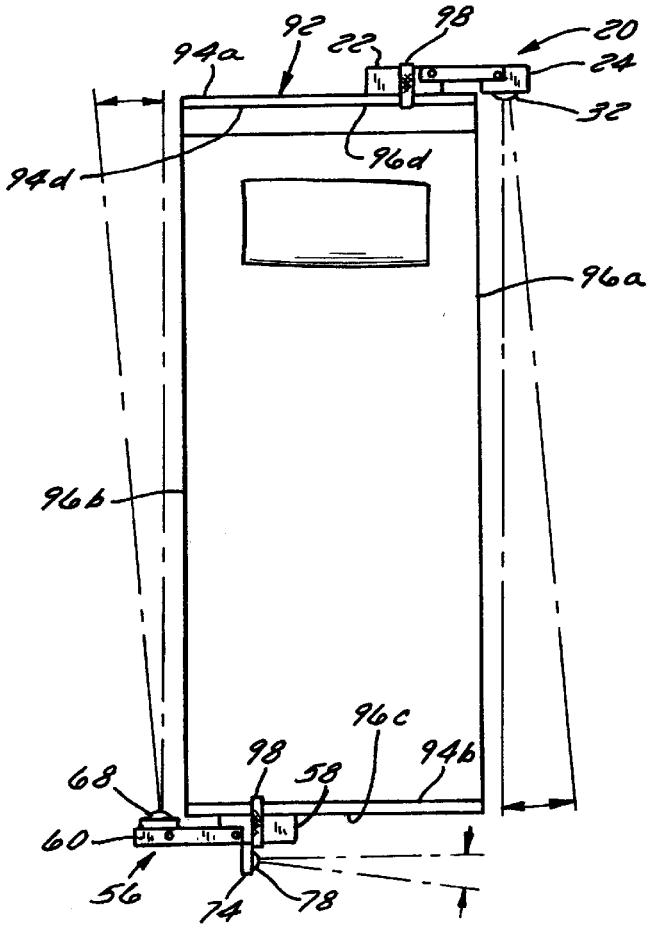
FIG. 12 is a schematic top view of the monitoring system as mounted in FIG. 11.

A monitoring system 18 constructed in accordance with a preferred embodiment of the invention is mountable either on a chair 90 as illustrated in FIG. 1 and operated in a "chair" mode or on a bed 92 as seen in FIG. 11 or 12 and operated in a "bed" mode. When it is mounted on the chair 90 as seen in FIG. 1, it monitors a volume on and/or in the vicinity of the chair 90 and generates an alarm whenever the monitored patient leaves the monitored volume. When mounted on a bed 92 as seen, e.g., in FIG. 11 or 12, it monitors a perimeter of the bed and 92 generates an alarm whenever the patient enters the perimeter. In both cases, the system 18 relies on the transmission, reflection, and receipt of energy intensity-independent signals for detection. The same base unit 20 is usable in both modes, and an additional remote unit 56 and one or more plug-in modules 74 may be used in the bed monitoring mode.

Referring to FIGS. 1–4, when the system 18 of the present invention is used to monitor a patient seated in a chair, all operations are performed by a base unit 20 mounted on the chair 90, preferably by being mounted on a novel chair cover 142. In a preferred embodiment, base unit 20 consists of a main box 22, a transducer box 24, and a cable 26 operationally connecting them. The boxes 22, 24 of base unit 20 are also connected structurally by way of an arm 28 and pins 30*a* and 30*b* that are lockable via corresponding knobs. Arm 28 and pin 30*a* allow main box 22 to pivot about one axis, while pin 30*b* allows transducer box 24 to pivot about another, parallel axis, thus providing the transducer box 24 with two degrees of freedom. A fixed monitor would be capable of monitoring only a part of the body, such as a patient's head, normally located at a specific location relative to the back of the chair. Because a larger range of volumes can be targeted and monitored, the system has greater versatility than one having a fixed transducer, and there is less chance of errant alarms due to normal patient movement. Pivoting arm 28 thus provides a means for creating a more relevant monitored volume.

Transducer box 24 houses a transducer 32. Transducer 32 acts as both a transmitter and a receiver of pulsed signals.

The pulsed signals may be infrared, sonic, ultrasonic, microwave, or any other reflectable, energy source. The preferred signals are sonic signals and are transmitted periodically at a rate of approximately one signal per second at a frequency of 20–100 kHz for monitoring a person in a chair and two signals per second for monitoring in a bed. The transducer 32 even more preferably used is a Polaroid 600 series environmental grade electrostatic transducer, part nos. 616342 & 607281, used in conjunction with a 6500 Series Transformer, part nos. 619392 & 619391.

Base unit 20 also contains a control circuit, an alarm generator, and a power source, none of which are shown, but all of which are known in the art. The circuit receives information from the receiver of transducer 32, measures an intensity-independent characteristic of the reflected signal, and compares that measured characteristic with a preset allowable value or range of values. When the monitored characteristics of the reflected signal is outside the allowable value or range of values, indicating that the patient has left a safe volume, the circuit activates an alarm generator which generates ah alarm. The alarm may be an audible or visible alarm provided on base unit 20, or may be a signal transmittable to a remote nurse's call station. The safe volume can be easily adjusted to fit the specific needs of the situation and enable a caregiver to be alerted when a person slides down, leans forward, or starts to leave the chair before he or she has physically left the chair. The manner in which the energy intensity-independent based measurements can be taken and used to monitor a patient seated in a chair are described in detail in commonly assigned U.S. Pat. No 6,204,767 (the '767 patent), the subject matter of which is hereby incorporated by reference in its entirety. Suffice it to say that the preferred technique is to measure the time of flight from signal transmission to reflected signal reception. In the "chair" or volumetric based monitoring mode described thus far and in the '767 patent, an alarm will be generated whenever a reflected signal is not received within a designated maximum and/or minimum time period, indicating that the person has left the monitored volume. Conversely, in the "bed" or perimeter based monitoring mode described below, an alarm will be generated whenever a reflected signal is received within a designated maximum and/or minimum time period, indicating that the person has broken a beam bordering the monitored location.

Figure 3:
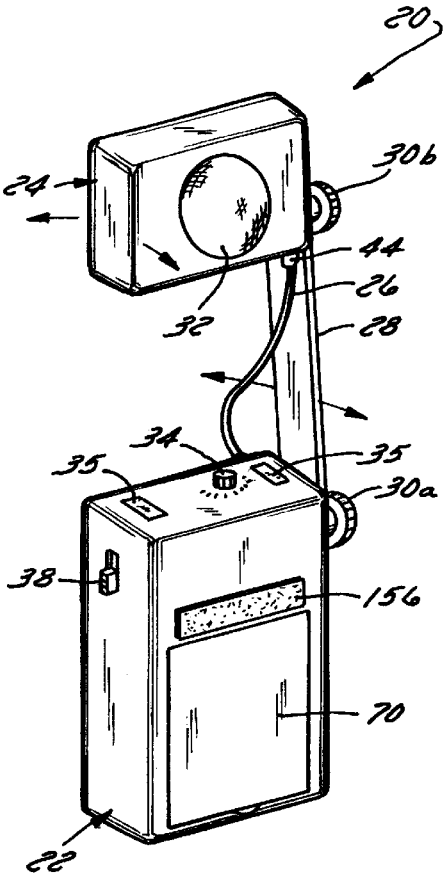
FIG. 3 is a perspective view of the base unit of FIG. 2, viewed from in front of and above the base unit.
Figure 4:
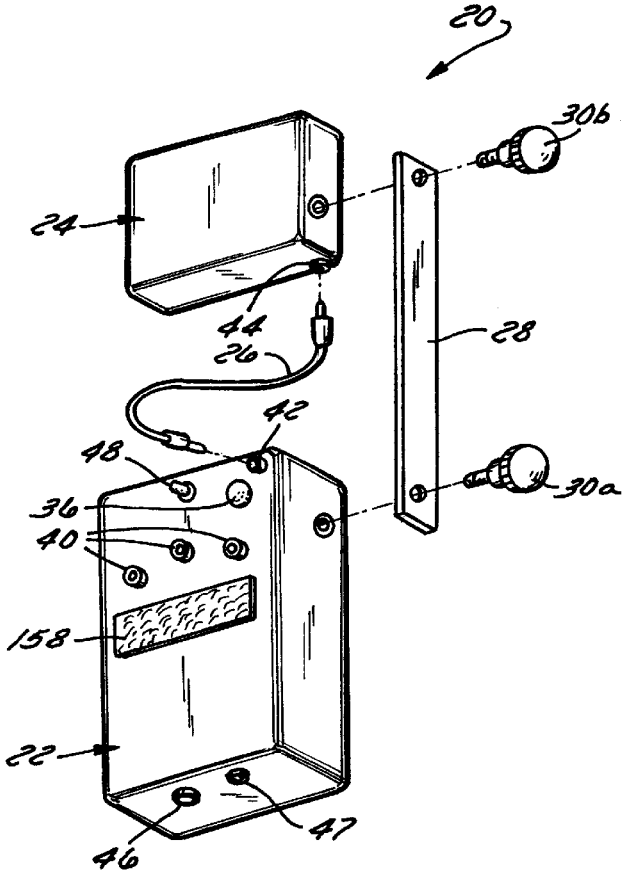
FIG. 4 is an exploded perspective view of the base unit, viewed from behind and below the base unit.

FIGS. 3 and 4 more clearly show details of base unit 20. The main box 22 supports several controls, ports, and indicators. Controls include a dial 34 mounted on top of the box 22, two ON-OFF switch membrane switches 35 on top of the box 22, a push-button reset switch 36 mounted on the front of the box 22, and a mode selection switch 38 mounted on the side of the box 22. Dial 34 effectively adjusts the rear and/or front ends of the beam to adjust the allowable maximum and/or minimum range of the signal return time. Mode selection switch 38 changes the operating mode of system 18 from the chair monitoring mode to the bed monitoring mode. The ports include three receptacles 40 for receiving pins 80 of a plug-in-module 74 as detailed below, an upper port 42 on the rear of the box 22 for receiving the cable 26 via a corresponding port 44 on the transducer box 24, a first lower port 46 for receiving a cable (not shown) that is capable of transmitting alarm and possibly other signals to a nurse's station or other remote unit, and second lower port 47 for receiving a cable connecting the base unit 20 to a remote unit 56 as detailed below. A nurse call cord transmits the signal to the nurse call system in the preferred mode, although a wireless activation could also be provided for those systems. The display includes an audible and/or visual alarm (not shown), an LED pilot light 48 that provides a pulsed visual indication that the main unit is operational and transmitting.

Figure 5:
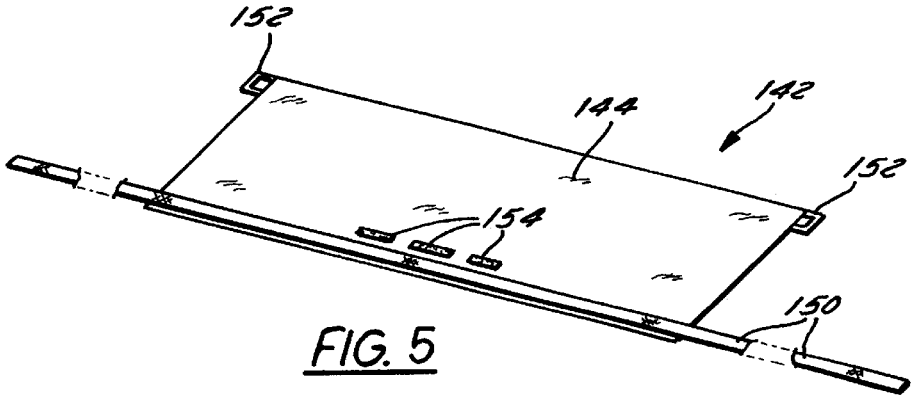
FIG. 5 is a perspective view of a preferred embodiment of a chair cover via which the base unit of the monitoring system can be mounted on the back of a chair.
Figure 6:
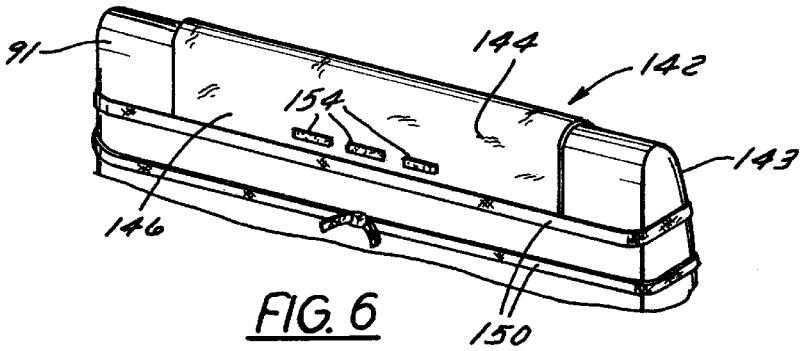
FIG. 6 is a perspective view of the chair cover shown in FIG. 5, taken from the rear of a chair to which it is attached.
Figure 7:
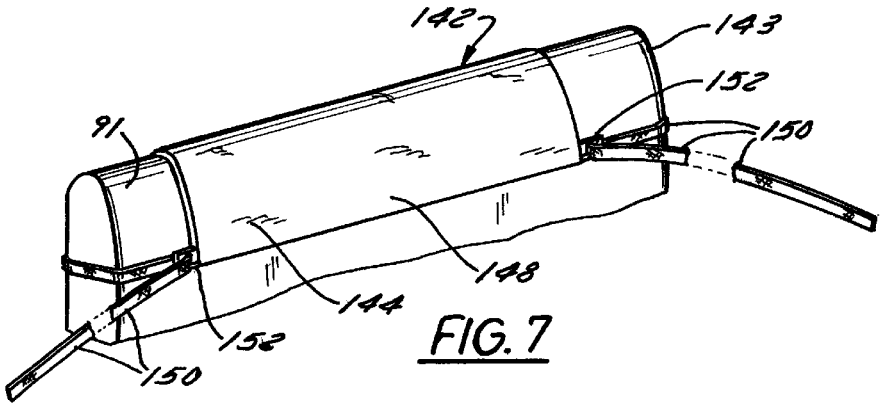
FIG. 7 corresponds to FIG. 6 and illustrates the front of the chair.

Turning now to FIGS. 5–7, a chair cover 142 is shown via which the base unit 20 can be easily mounted on and removed from a back 91 of the chair 90. Chair cover 142 is preferably constructed of a sheet 144 that allows it to drape over the top of the chair back 91 as shown in FIGS. 6 and 7. A rear-facing surface 146 of sheet 144 is outfitted with a strap 150 near one edge thereof, while an opposed front-facing surface 148 bears a pair of strap retaining loops 152 at the opposite edge thereof In the illustrated embodiment, sheet 144 is 13½" long and 8" wide, and the strap is 80" long and 1" wide. Strap 150 is self-fastening by virtue of being covered with the loop side of hook-and-loop fastening tape except at the last 6" of each end, which are covered with the hook side of hook-and-loop fastening tape. As best seen in FIGS. 6 and 7, the sheet 144 may be folded over the top of the chair back 91 so that the straps 150 on the rear surface 148 are aligned with and fastenable to the loops 152 on the front surface to removably secure the chair cover 142 to the chair back 91. The under side of the chair cover 142 has an anti-slip strip sewn on to prevent slippage of the cover.

Chair cover 142 also has fastening sites 154 for attachment of base unit 20 thereto. In the preferred embodiment, in which the base unit 20 is mounted on the chair cover 142 via hook-and-loop fasteners, sites 154 comprise Velcro® strips configured for engagement with a mating strips 156 of Velcro® tape on the base unit box 22. Additional Velcro® strips 158 are provided on front of the box 22 for connection to straps 98 (FIGS. 11 and 12) usable to mount the main unit 20 on a bed 92 as described below.

Hence, it can be seen that chair cover 142 can be used on a wide variety of chair types and sizes, including recliners, desk chairs, side chairs, and wheelchairs. It is advantageous in that no modification needs to be made to the chair itself in order to use the monitor. A patient therefore can sit in a preferred chair rather than being required to use a chair which is specially configured to accommodate a monitor. The base unit 20 of the monitoring system 18 can be easily relocated from chair to chair or from a chair to a bed when needed, such as when a patient moves from a wheelchair into a regular chair or from a wheelchair to a bed. The sheet 144 can also be easily removed and cleaned.

However, it should be noted that the preferred construction described above is not meant to be limiting. For instance, the locations of the strap 150 and loops 152 could be reversed; strap 150 could be a pair of elasticized straps attached from front to back or side to side rather than a single self-fastening strap 150 extending from rear surface 146 to front surface 148; and the retaining loops 152 could be replaced with a grommet or other device. Likewise, while Velcro® brand fastening tape is discussed as the preferred connection between base unit 20 and chair cover 142, it should be apparent that many other suitable fastening arrangements, such as snaps, could be devised. Furthermore, sheet 144 may be constructed of any suitable material, such as a machine washable fabric or a plastic sheet, in any suitable dimensions, so long as chair cover 142 provides simple, inexpensive mounting of a monitor to a chair. The chair cover 142 could also be used to mount the main controller 20 directly to the bed without the strap 98.

Figure 8:
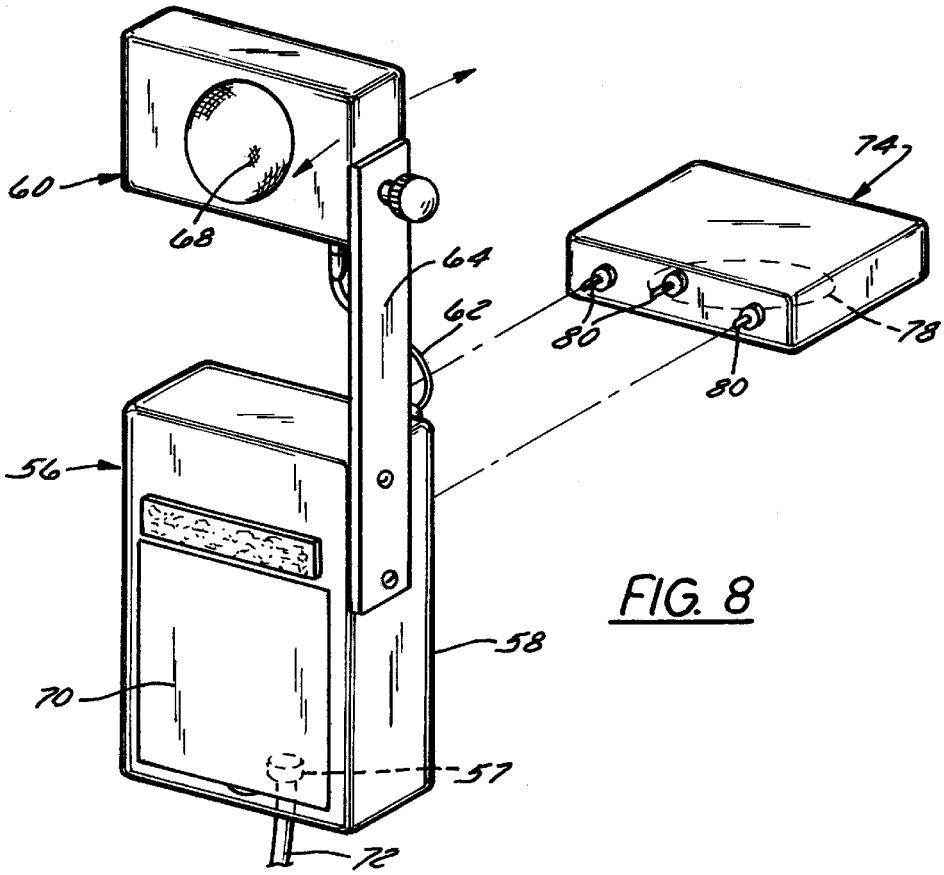
FIG. 8 is an exploded perspective view of a remote unit and a plug-in module that can supplement the base of the system for bed or other monitoring applications.
Figure 10:
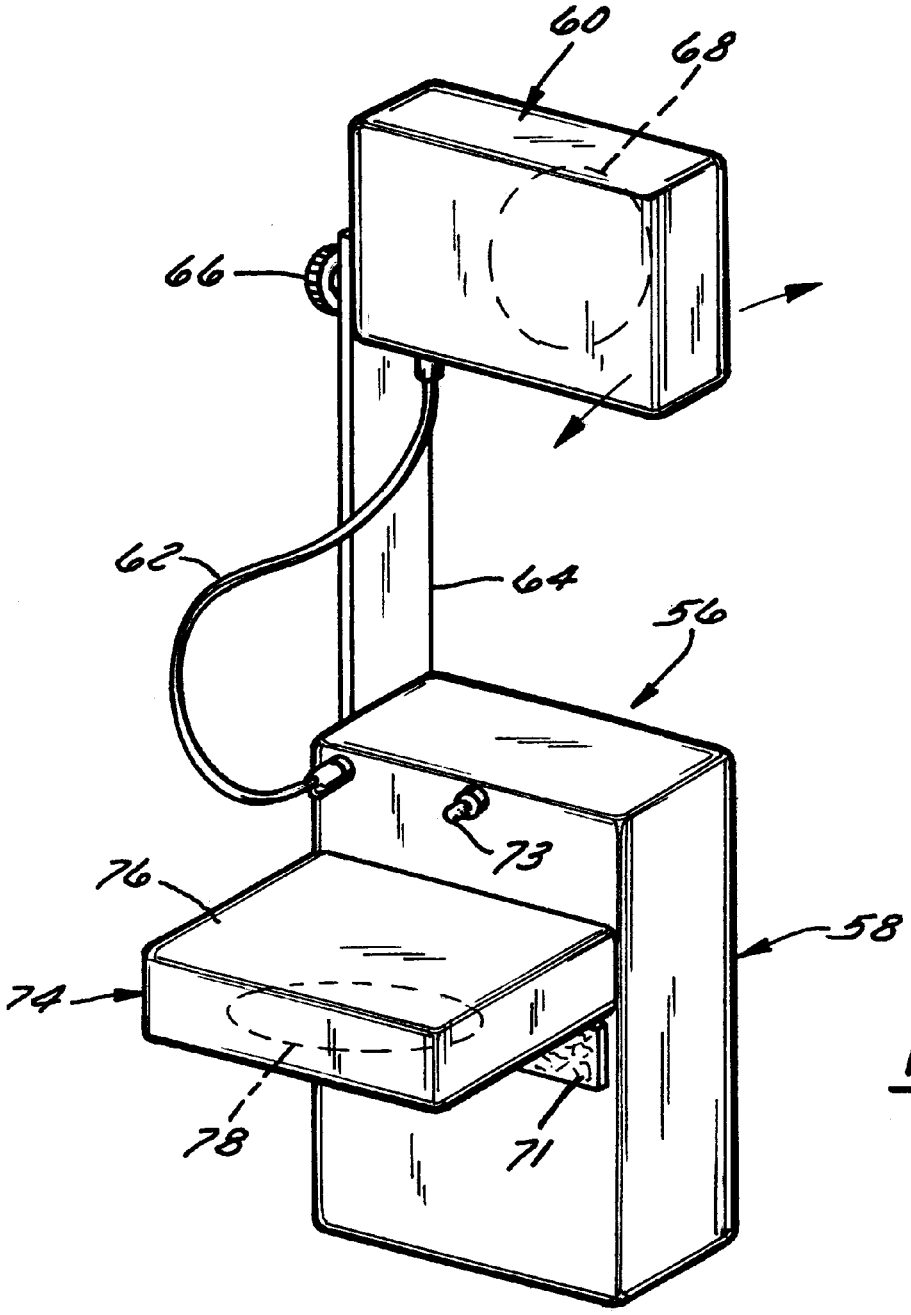
FIG. 10 corresponds to FIG. 9 but shows the plug-in module plugged into the remote unit.

Turning now to FIGS. 8 and 10, remote unit 56 is very similar to base unit 20 in that it has a main box 58, a transducer box 60, cable 62, an arm 64, a pivot pin 66, a transducer 68 of the same type as previously described in connection with base unit 20, and Velcro® brand fastening strips 71 on the opposed front and rear surfaces of the main box 58 for mounting on straps 98 (FIGS. 11 and 12). The tightenable pivot pin 66 permits the transducer box 60 to be mounted on the top of the arm 64 so as to pivot about the arm 66 in the same manner as the transducer box 24 of the base unit 20. However, because the remote unit 56 is configured for perimeter monitoring rather than volume monitoring and, therefore, requires less freedom of positioning, the lower end of the arm 64 can be fixed to the main box 58 rather than pivotably mounted on it. Of course, an equally viable design alternative would be to pivotably mount the lower end of the arm 64 on the main box 58 using the same or similar pivot mount used to mount the arm 64 of the base unit 20.

The main box 58 of the remote unit 56 differs from the main box 22 of the base unit 20 in that an alarm generator are not provided within. It also lacks the switches, the dial, and a port of the base unit 20. Rather, remote unit 56 is slaved to the base unit 20 by connecting a port 57 on the bottom of the main box 58 to the port 47 on the main unit main box 22 via the cord 72. As a result, the remote unit's internal circuitry relies on the circuit, alarm generator, and activation of the base unit 20 for its operation. The remote unit 56 houses batteries (not shown) to power itself when the remote unit 56 is activated by the base unit 20. When the remote unit 56 is connected to the main unit 20 by the cord 72, remote unit 56 transmits a signal, receives a reflected signal, and provides the reflected signal information to the circuit of base unit 20 for measurement and comparison as described below in connection with FIG. 14. A visual indication of the operation of the remote unit 56 is indicated by a pilot light 73 on back of the main box 58.

Figure 9:
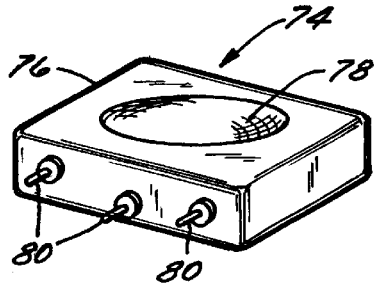
FIG. 9 is a perspective view of the plug-in module of FIG. 8.

Referring to FIGS. 8–10, the plug-in module 74 is configured to add still additional functionality to the monitoring system 18 when the system 18 is used in the bed monitoring mode. Plug-in module 74 consists of a module box 76 bearing a transducer 78 and three snap-in banana plugs or pins 80. The transducer 78 is preferably of the same type as those already been described. Pins 80 snap into the ports 40 of the main box 22 of the base unit 20 or, alternatively, into corresponding ports (not shown) in the main box 58 of the remote unit 56 to slave the plug-in module 74 to the connected structure. Hence, in the example illustrated in FIGS. 8–10, the plug-in module 74 is plugged into the main box 58 of the remote unit 56. When so connected, transducer 78 transmits a signal in a direction that is at least generally perpendicular to the direction of transmission of the signal generated by the transducer 68 of the remote unit 56. Relevant information regarding any reflected signal (most likely time of flight in the preferred, sonar-based embodiment) is then transmitted to circuitry of the remote unit 56 via the pins 80, which in turn transmits the information to the circuit of base unit 20 for measurement and comparison using the procedure discussed below in connection with FIG. 15.

When system 18 is used on a bed 92, as shown in FIGS. 11 and 12, the base unit 20 is strapped to the bed using straps at a first location to monitor a first leg of the perimeter of the bed 92, the remote unit 56 is placed in a second location to monitor a second leg of the perimeter of the bed 92, and the plug-in module 74 may additionally be employed to monitor a third leg of the perimeter of bed 92. FIGS. 11 and 12 show two possible mounting configurations of these components in use on a bed 92.

FIG. 11 is a rear view of a headboard 94*a* of bed 92. A base unit 20 and a remote unit 56 are strapped to the edges of the headboard 94*a* by straps 98 to monitor two sides of bed 92. (The components 20 and 56 could be mounted on a footboard (not shown) with equal effectiveness.) Straps 98 on the headboard 94*a* are provided with hook-and-loop fastening tape to mate with the hook-and-loop fastening strips 156, 158 provided on base unit 20 and the corresponding strips 70 and 71 remote unit 56. In a preferred embodiment, straps 98 are cinched tightly to the headboard 94*a* using cinches 100. Naturally, a variety of other easily adjusted fastening arrangements that would not require permanent mounting to headboard 94*a* could also be used. When so configured, the base unit 20 and remote unit 56 monitor the opposed sides of the bed 92 and generate an alarm whenever a patient enters a beam transmitted from either transducer 32 or 68 within a settable distance and period. Because of the physical location of the bed 92 or the capabilities of the monitored patient, this application does not require the monitoring of any other portion of the bed's perimeter. Hence, no plug-in modules are utilized.

FIG. 12 shows an alternative application in which three legs of the perimeter of the bed 92 are monitored. In this application, the base unit 20 is mounted on the headboard 94*a* at one side 96*a* of the bed 92, the remote unit 56 is mounted on the footboard 94*b* on the opposite side 96*b* of the bed, and a plug-in module 74 is plugged into remote unit 56 so as to monitor a third leg 96*c* running along the footboard 94*b*. If desired, another plug-in-module 74 (not shown) could be plugged into the base unit 20 to monitor a fourth leg 96*d* of the perimeter of the bed running along the headboard 94*a*, hence monitoring the entire perimeter.

3. Operation

Figure 2:
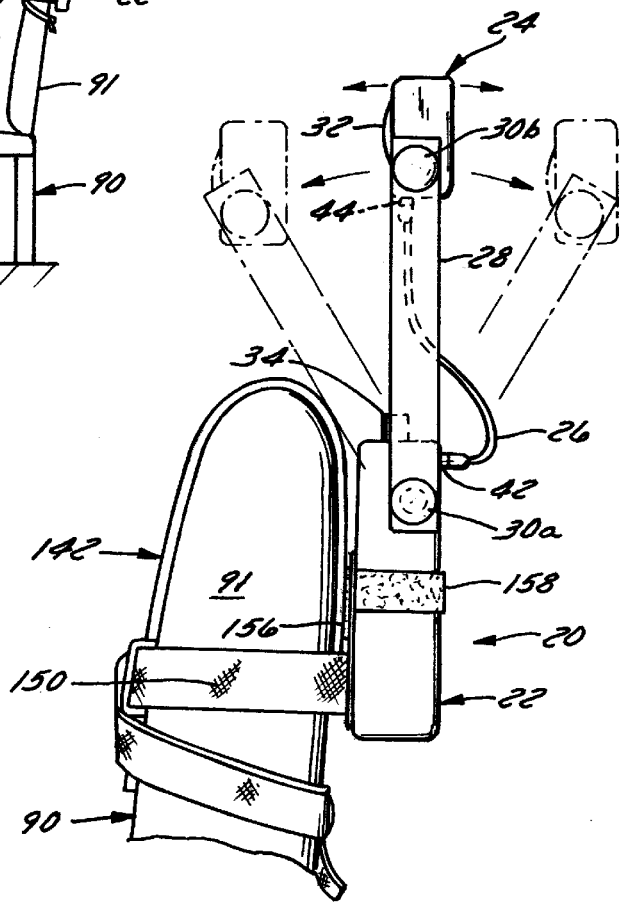
FIG. 2 is a side elevation view of the base unit of the system, shown mounted on a chair.

As indicated above, the system 18 can be used on either a chair 90 or similar structure and operated in a first mode, or can be used on a bed 92 or similar structure and operated in a second mode. When the system 18 is used on a chair 90, a patient or caregiver selects a chair 90 in which the patient will be seated, and the caregiver securely attaches chair cover 142 to the headrest or chair back area 91 of chair 90. The caregiver then attaches base unit 20 to chair cover 142 and adjusts arm 28 so that transducer 32 is aimed at a desired portion of the patient's body, usually the patient's back as illustrated in FIGS. 1 and 2. The caregiver then turns base unit 20 on using one of the switches 35 and switches switch 38 to "chair" mode.

Transducer 32 transmits a pulsed, energy intensity-independent signal in the direction of the patient's back or head and subsequently receives the signal, as it is reflected from the patient. The circuit measures the time elapse between sending a signal and receiving the signal in return. In this "chair" mode, the time elapsed should not vary from between a range indicating that the patient is in position. This range is settable using the dial 34. However, if a patient should begin to slump in his or her chair, and finally move out of range so that the elapsed time is too long, the alarm will sound. The patient thus has a wide range of allowed movement within an area and a caregiver will not be bothered with false alarms due to normal patient movement. However, an alarm will sound while the patient is still in the chair, even if he or she has not yet fallen. The alarm thus provides information not about falling, but about the imminent danger of falling. This volumetric, energy intensity-independent based measurement, and the advantages of this measurement when compared to an energy intensity-based measurement, are described in greater detail in the '767 patent.

When the caregiver wishes to use the system to monitor a patient lying in a bed 92, the base unit 20 is removed from the chair 90 and strapped on a bed 92. For some applications, a single base unit 20 may provide adequate monitoring. For instance, a bed 92 may have a headboard and footboard that are impossible to traverse and have one side positioned against a wall, leaving only one side open for patient ingress and egress.

For other applications, more than one side of bed 92 will need to be monitored. In that case, the caregiver may connect a remote unit 56 to base unit 20 using cord 72 and strap remote unit 56 to the other side of the bed as described above in connection with FIG. 11. He or she may also employ one or more plug-in modules 74 to monitor the ends of the bed 92 as discussed above in connection with FIG. 12.

Referring again to FIG. 12 by way of example, when the appropriate legs of the bed's perimeter have been selected for monitoring by adding the appropriate remote unit 56 or plug-in modules 74, the caregiver adjusts arms 28, 64 so that transducers 32, 68, 78 are aimed to transmit signals along the monitored legs of the perimeter of bed 92 without crossing into bed 92. Hence, the inner edges of the diverging beam from each transducer runs at least substantially parallel with and adjacent to the associated monitored side of the bed 92. This provides the patient with the maximum area of movement possible within the bed 92 so that alarms are not generated by normal patient movement. The caregiver then turns base unit 20 on and switches switch 38 to "bed" mode. In this mode, transducers 32, 68, and/or 78 transmit a pulsed signal at the perimeter of the patient's bed 92 and subsequently receive signals within a pre-determined, adjustable range. The circuit measures the elapsed time between sending a signal and receiving the signal in return. The elapsed time between transmission and reception will remain outside of the designated range as long as there is no movement into a monitored portion of the length of transmitted beam. This range is settable using the dial 34 to set the monitored portion of the transmitted beam to coincide with a designated portion of the associated leg of the bed's perimeter. When a patient (or other person or object) crosses a monitored leg or monitored portion of a leg of the perimeter, he or she generates a return signal within the monitored period, and the alarm is generated. A caregiver thus is alerted immediately that the patient may be attempting to get out of bed and may fall. This provides an instant audible alarm before the patient has left the bed along with activation of the nurse call system through the nurse call cord or other suitable means.

The dial 34 will usually be set to cause the monitored portion of the transmitted beam to equal the length of the associated leg of the bed's perimeter. However, it will often be necessary for caregivers to have access to the patient, to feed him or her, to bathe or administer medicine to him or her, or simply to hold his or her hand, without turning off system 18 and without setting off an alarm. This access is provided is by adjusting the base unit 20 to alter the monitored portion of the length of the transmitted beam. For instance, the dial 34 on the base unit 20 can be manipulated to reduce the maximum permissible return time and/or increase a minimum permissible return time to something greater than zero. The length of the monitored perimeter leg is thus shortened, and a space is created at one or both ends of the bed through which people and articles may pass without generating an alarm. This allows a patient to eat, play cards, receive mail, or perform other normal activities while still being monitored but without setting off an alarm. When activities are through, the dial 34 can be manipulated to return the monitored length perimeter to the full length of the bed 92.

Figure 13:
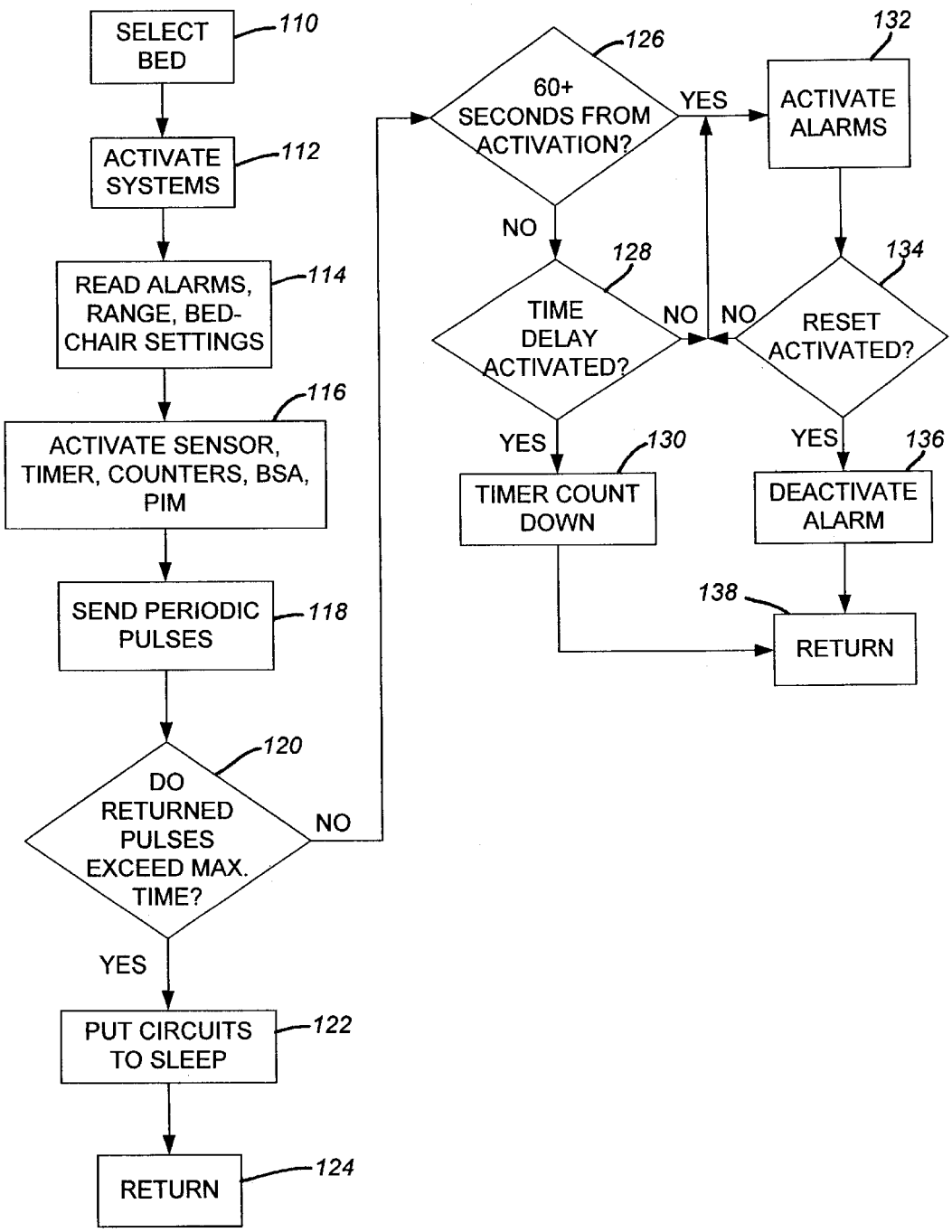
FIG. 13 is a flow chart of the operation of the base unit of the monitoring when the system is set for a bed monitoring mode.
Figure 14:
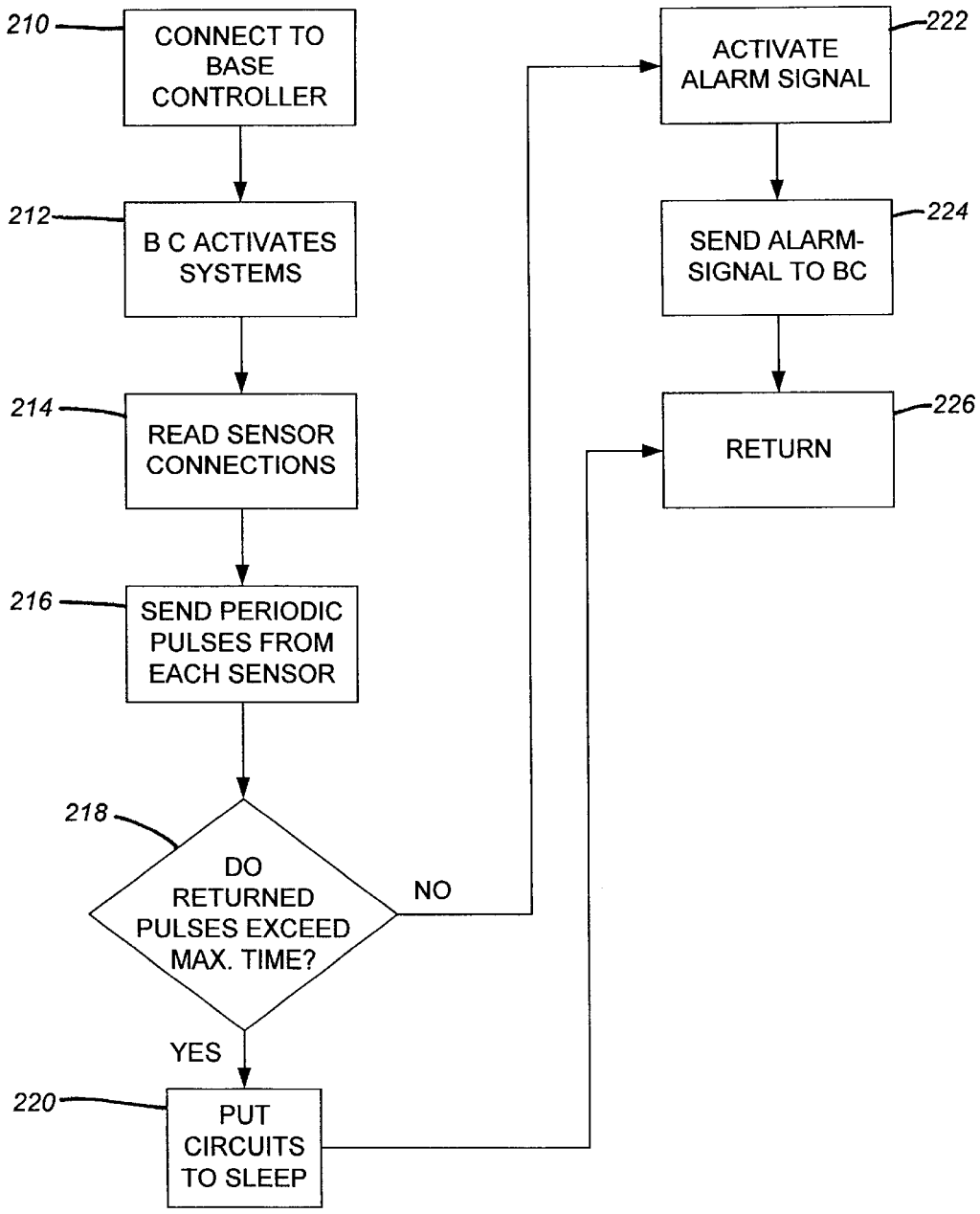
FIG. 14 is a flow chart of the operation of the remote unit in the bed monitoring mode.
Figure 15:
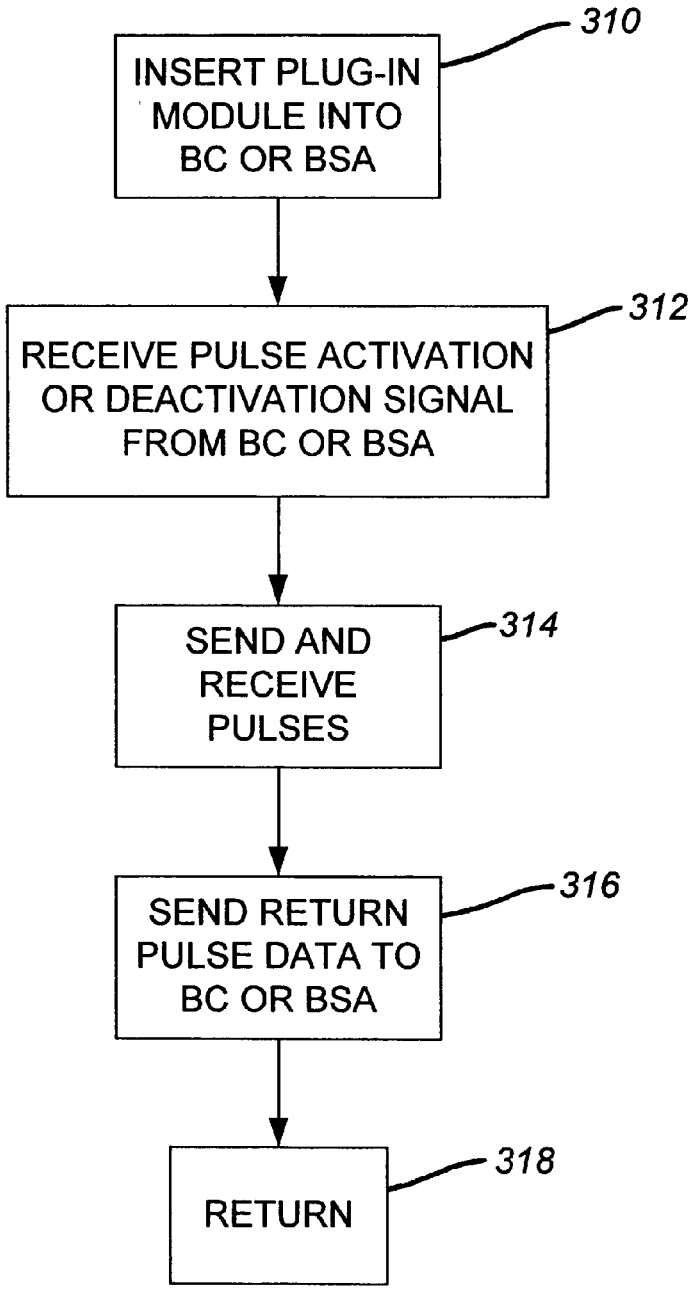
FIG. 15 is a flow chart of the operation of the plug-in module in the bed monitoring mode.

The details of the manner in which an alarm is generated in "bed" mode can be better appreciated with reference to FIGS. 13–15, which provide flowcharts of the operation of the major system components 20, 56, and 74 in bed mode. Referring initially to FIG. 13, in the first step 110 in the operation of the main unit 20, a caregiver selects the bed mode by suitable operation of the switch 38. The existing alarm settings, range parameters, and selection of bed mode are read 114. The main unit's sensor, timer, counters, and other system components are then activated, as shown in 116.

Pulses are then transmitted at predetermined intervals as illustrated at 118. Then, in Block 120, the routine inquires as to whether the return time of any of pulses have exceeded a maximum threshold indicative of the length of the perimeter leg monitored by the base unit 20. If so, the system "sleeps" at 122 and proceeds to RETURN at 124, where it continues its normal activity of sending periodic pulses. In an example using the preferred embodiment of the invention, the circuit of base unit 20 does not tell the alarm generator to generate an alarm. Thus, if a base unit 20 is set to monitor an entire side of a bed 92, and the pulses have traveled equal to or longer than the length of the side, no alarm is generated.

If it is determined in Block 120 that the pulses have returned in less than the time allotted or outside of a range of allotted times, a nuisance alarm prevention/time delay detection subroutine is activated. Specifically, in Block 126, the routine determines whether the system has been active for at least 60 seconds and whether a time delay function has been activated at 128. If the system time delay function has been activated, after the initial 60 second set-up window, a timer countdown begins at 130, and the system continues its normal activity of sending periodic pulses. If, on the other hand, the routine determines at Block 126 that the system has been activated for more than 60 seconds, and determines in Block 128 that no time delay function has been activated, an alarm is generated in Block 132. The alarm thereafter remains generated until the system is reset in 134, whereupon the alarm is deactivated 136 for 60 seconds. The system then resumes its normal monitoring function 138.

Hence, Block 126 shows that a 60 second window is provided immediately after activating the system 18 in which an alarm will be generated whenever the monitored portion of a transmitted beam is broken even if the system is instructed to reset during that period. This provides the caregiver with an opportunity to set up the system properly and adjust the sensing heads as needed.

Block 128 indicates that the alarm generator of base unit 20 also has the capacity, after the initial 60 second set-up period, via operation of pushbutton 36 or other suitable means, to be temporarily overridden when a caregiver needs to access the patient. Block 134 also indicates that the alarm can be reset, via the power switches 35 or other suitable means, at any time. This enables nursing staff or a caregiver to instruct the patient, move the patient, or perform other brief duties without generating nuisance alarms while he or she is present, while still providing a controlled, alarm-inducing situation when the patient is unattended. A short beep at 55 seconds indicates the alarm will automatically reset and activate within 5 seconds unless another 60 second delay is activated.

Referring now to FIG. 14, operation of the remote unit 56 in "bed" mode begins at 210 with the connection of the remote unit 56 to the base unit 20. When the base unit 20 is turned on, it then activates the remote unit in Block 212, whereupon the remote unit's internal circuitry reads system settings (as input into the base unit 20) at 214. The transducer 68 is then actuated to periodically transmit pulses at 216.

In Block 218, the routine determines whether the return time of any pulses from the remote unit 56 exceeds the allotted time. If so, the system "sleeps" at Block 220, or continues its normal activity of sending periodic pulses without generating an alarm signal. If the pulses do return in less than the allotted time, the remote unit 56 activates an alarm signal in Block 222 and transmits that signal to the base unit 20 in Block 224, which then enters the alarm routine shown in FIG. 13 and described above. The remote unit 56 then returns to sending pulses at 226.

Finally, FIG. 15 illustrates a method that could be implemented by the plug-in module(s) 74 of the preferred embodiment in "bed" mode. When a plug-in-module 74 is inserted into the base unit 20 and/or the remote unit 56 at 310, it is activated when the base unit is turned on by the unit into which it is inserted at 312 and proceeds to transmit and receive pulses at 314. All information received is sent to the unit in which it is inserted at Block 316. That information is employed by the circuitry of the relevant unit 20 or 56 to either generate or not generate an alarm using the relevant portion of the relevant routine(s) of FIGS. 13 and/or 14. The plug-in-module 74 then continues to send and receive pulses at 318 until the system is deactivated.

Many changes and alterations can be made to the system described herein without departing from the spirit of the invention. For instance, although the system has been described primarily in conjunction with monitoring a patient seated in a chair or lying in a bed, the system could also be used in the "bed" mode to detect patient entry or exit to or from a variety of other locations such as a hallway, entryway, or bathroom. It could also be used in "chair" mode, and possibly (depending on its configuration) in "bed" mode to monitor other patient-accessible locations such as a sink, a walker, or a toilet.

In addition, the "chair" or volumetric monitoring concept and the "bed" or perimeter based measuring concept could be programmed into stand-alone dedicated or switchable units built into the chair, bed, or other application for which it is intended.

The scope of still other changes will become apparent from the appended claims.

I claim:

1. A patient monitoring system comprising:

(A) a base unit configured to be alternatively mounted to one of a patient chair and a patient bed, the base unit comprising a first transmitter, a first receiver, a circuit, and an alarm generator; and wherein the first transmitter transmits a pulsed signal at pre-determined intervals, the first receiver receives a reflected signal, the circuit measures an intensity-independent characteristic of the reflected signal, and the alarm generator generates an alarm signal when the circuit determines that a pre-determined threshold of the reflected signal has been reached; and (B) at least one remote unit comprising a second transmitter and a second receiver.

2. The system of claim 1, wherein the base unit further comprises a pivotable arm bearing the first transmitter and first receiver.

3. The system of claim 1, wherein the at least one remote unit further comprises a pivotable arm bearing the second transmitter and second receiver.

4. The system of claim 1, wherein the pulsed signals define a monitored area.

5. The system of claim 4, wherein the base unit further comprises a knob which adjusts at least one of maximum and minimum length of a monitored area.

6. The system of claim 1, wherein the base unit is aimed at a first angle defining a first leg of a monitored perimeter.

7. The system of claim 6, wherein the at least one remote unit is electrically coupled to the base unit and the at least one remote unit is aimed at a second angle defining a second leg of the monitored perimeter.

8. The system of claim 6, further comprising a first plug-in module comprising a third transmitter and a third receiver, and wherein the first plug-in module utilizes the circuit and the generator of the base unit and is aimed at a third angle defining a third leg of the monitored perimeter.

9. The system of claim 8, further comprising a second plug-in module comprising a fourth transmitter and fourth receiver, and wherein the second plug-in module utilizes the circuit and the alarm generator of the base unit and is aimed at a fourth angle defining a fourth leg of the monitored perimeter.

10. The system of claim 1, wherein the base unit further comprises a switch for switching between a first monitoring strategy to be used when the base unit is mounted to a patient chair and a second monitoring strategy to be used when the base unit is mounted to a patient bed.

11. The system of claim 1, further comprising a chair cover comprising:

a flexible sheet;

at least one self-fastening strap extending from an edge of the flexible sheet;

at least one receptacle attached to the flexible sheet through which the strap is drawn; and a fastening site for detachable connection of the base unit to the chair cover.

12. The system of claim 11, wherein the fastening site comprises one side of a hook-and-loop fastening tape and the base unit bears the other side of a hook-and-loop fastening tape.

13. A patient monitoring system comprising:

(A) a chair mounting unit comprising a flexible cover portion, at least one strap and at least one strap releasably connected with the cover portion, and a fastening site for detachable connection of a monitoring unit to the chair mounting unit; and (B) a monitoring unit comprising a transmitter, a receiver, a circuit, and an alarm generator, the monitoring unit being releasably mounted on the fastening site of the chair mounting unit.

14. A patient monitoring system comprising:

(A) a base unit configured to be alternatively mounted in first and second locations; and (B) a switch for switching between a first monitoring strategy to be used when the base unit is located at the first location and a second monitoring strategy to be used when the base unit is located at the second location.

15. The system of claim 14, wherein the first monitoring strategy comprises transmitting a signal into a volume of interest in which a patient is expected to be located and generating an alarm if the patient leaves the volume of interest, and wherein the second monitoring strategy comprises transmitting a signal adjacent an area of interest and generating an alarm signal if a person leaves the area of interest.

16. The system of claim 15, wherein the first monitoring measuring strategy comprises measuring return time of the reflected signal and, when an out-of-range return time is identified, generating an alarm to indicate that a patient is not in the monitored volume, and wherein the second monitoring strategy comprises measuring a return time of the reflected signal and, when an out-of-range return time is identified, generating an alarm to indicate that a patient has interfered with the monitored area.

17. The system of claim 16, wherein the first and second locations are a chair and a bed, respectively.

18. A method of monitoring patients comprising:

(A) attaching a base unit including a sensor to a chair;

(B) directing the sensor of the base unit at a patient to be monitored;

(C) selecting a "chair" mode on the base unit and monitoring a patient seated in the chair;

(D) removing the base unit from the chair and attaching it to the patient's bed;

(E) directing the sensor of the base unit to the perimeter of the patient's bed; and (F) selecting a "bed" mode on the base unit and monitoring a patient positioned in the bed.

19. The method of claim 18, wherein the step of attaching the base unit to the chair further includes attaching the base unit to a chair cover removably mounted on the chair.

20. The method of claim 18, wherein the step of directing the sensor at the patient further includes directing the sensor toward the patient's back.

21. The method of claim 18, further comprising, after removing the base unit from the chair, plugging a plug-in sensor unit into the base unit.

22. The method of claim 18, further comprising, after removing the base unit from the chair, connecting a secondary sensor unit having a secondary sensor to the bed.

23. The method of claim 22, further comprising plugging a plug-in sensor unit into the secondary sensor unit.

24. The method of claim 18, further comprising, while the base unit is mounted on the bed, (A) adjusting a monitored length to cover substantially an entire length of a side of the bed; and (B) readjusting the monitored length to cover a less than the entire length of the side of the bed so that the monitored length is shorter than the entire length of the side of the bed in order to provide access to the patient without generating an alarm.

* * * * *